United States Patent [19]

Hahm

[11] Patent Number: 4,946,765

[45] Date of Patent: Aug. 7, 1990

[54] PHOTOGRAPHIC MATERIAL WITH INCREASED EXPOSURE LATITUDE

[75] Inventor: Paul T. Hahm, Hilton, N.Y.

[73] Assignee: Eastman Kodak Company, Rochester, N.Y.

[21] Appl. No.: 232,259

[22] Filed: Aug. 15, 1988

[51] Int. Cl.[5] ..... G03C 1/46; G03C 7/20

[52] U.S. Cl. ..... 430/504; 430/505

[58] Field of Search ..... 430/504, 505, 940, 359, 430/222

[56] References Cited

U.S. PATENT DOCUMENTS

| | | | |
|---|---|---|---|
| 4,141,730 | 2/1979 | Minagawa et al. | 430/359 |
| 4,173,479 | 11/1979 | Ranz et al. | 430/559 |
| 4,186,011 | 1/1980 | Lohmann et al. | 430/505 |
| 4,359,521 | 11/1982 | Fryberg et al. | 430/505 |
| 4,542,091 | 9/1985 | Sasaki et al. | 430/505 |
| 4,806,460 | 2/1989 | Ogawa et al. | 430/504 |
| 4,902,609 | 2/1990 | Hahm | 430/504 |

FOREIGN PATENT DOCUMENTS

| | | | |
|---|---|---|---|
| 1002626 | 2/1957 | Fed. Rep. of Germany . | |
| 145941 | 8/1983 | Japan | 430/504 |
| 1020038 | 1/1986 | Japan | 430/505 |

*Primary Examiner*—Paul R. Michl
*Assistant Examiner*—Lee C. Wright
*Attorney, Agent, or Firm*—Joshua G. Levitt

[57] ABSTRACT

There is described a photographic element in which increased exposure latitude is obtained by having a dye-forming coupler in a non-light-sensitive interlayer between two light-sensitive silver halide emulsion layers. One of the silver halide emulsion layers is sensitive to a first region of the spectrum and contains a dye-forming coupler that forms a dye complementary in color to the region of the spectrum to which that layer is sensitive. The second emulsion layer is sensitive to a second region of the spectrum and contains a second coupler that forms a dye complementary to the second region of the visible spectrum. The exposure latitude in the layer sensitive to the first region of the spectrum is increased when the coupler in the interlayer forms a dye complementary in color to the second region of the spectrum, but as a function of development in the first region of the spectrum.

11 Claims, 1 Drawing Sheet

PHOTOGRAPHIC MATERIAL WITH INCREASED EXPOSURE LATITUDE

Figure 1:
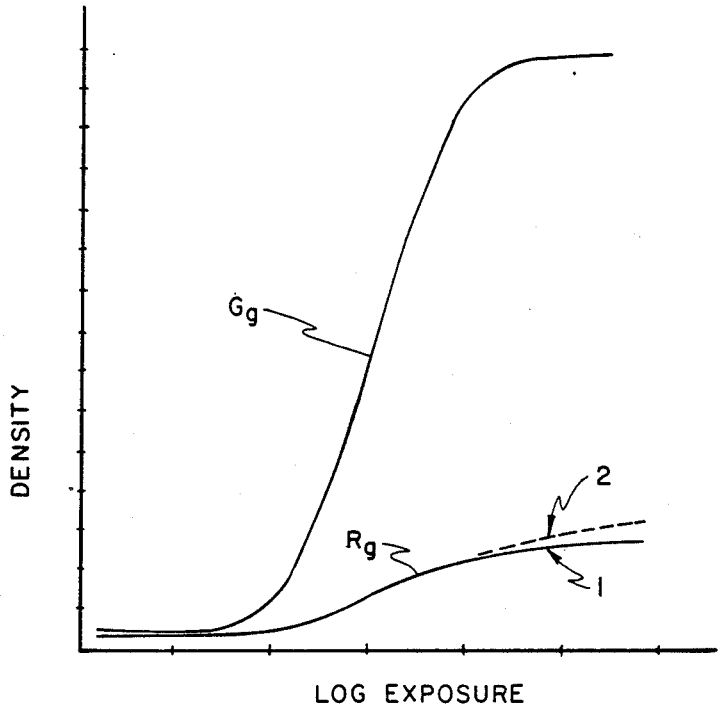

This invention relates to color photographic materials with extended exposure latitude. In a particular aspect, it relates to such a material which yields a positive image that is directly viewable.

BACKGROUND OF THE INVENTION

Color positive photographic prints intended for direct viewing are typically made by imagewise exposing a support coated with layers sensitive to each of the blue, green and red regions of the visible spectrum and which yield yellow, magenta and cyan dye images, respectively. Exposure is commonly to a color negative film which contains a negative image of the original scene. If the exposure latitude of the color print material is less than the full range of densities recorded in the film, reproduction of detail in the print will be poor.

Exposure latitude is a measure of the ability of a recording material to represent differences in intensity of exposure by differences in density. Thus, materials with a wide exposure latitude would respond to a wide range of exposure intensities by showing differences in image density, while materials with a narrow exposure latitude would, for the same range of exposure intensities, show fewer differences in density. Heretofore, exposure latitude typically has been modified by manipulation of the silver halide emulsion. For example, increasing the range of grain sizes in an emulsion is known to extend the exposure latitude, while narrowing the range of grain sizes is known to decrease exposure latitude. U.S. Pat. No. 3,663,228, issued May 16, 1972, to C. W. Wyckoff, discloses other techniques for extending the exposure latitude of color photographic materials.

In my copending U.S. Pat. Application Ser. No. 87,276, filed Aug. 20, 1987, now U.S. Pat. No. 4,902,609 issued Feb. 20, 1990 I describe a novel technique for extending exposure latitude of photographic materials. In accordance with that invention, there is provided a color photographic element comprising a support and first and second silver halide emulsion layers. The first emulsion layer is sensitized to a first region of the spectrum and the second emulsion layer is sensitized to a second region of the spectrum and, to a limited degree, to the first region of the spectrum. Dye density formed in the second emulsion layer as a result of its exposure to the first region of the spectrum, adds to the dye density formed in the first emulsion layer and thereby extends the exposure latitude. This is perceived as an increase in the degree of detail viewable in the image.

While this is a useful technique, it requires adjusting the degree of spectral sensitivity of the emulsion in the second emulsion layer for two different regions of the spectrum. It would be desirable to provide a means for accomplishing a similar extension of exposure latitude without having to manage the spectral sensitivity of an emulsion to two different regions of the spectrum.

I have found that exposure latitude can be extended by providing a color photographic material comprising;

a support first and second silver halide emulsion layers each sensitive to a different region of the electromagnetic spectrum and each layer containing a coupler that forms a dye complementary in color to the principal spectral sensitivity of the emulsion, and a non-light sensitive interlayer between the two emulsion layers, wherein:

the interlayer contains a coupler that forms, as a function of development of the first emulsion layer, a dye complementary in color to the principal sensitivity of the second emulsion layer.

In a specific embodiment of this invention, a cyan dye forming coupler is in an interlayer between a green sensitive silver halide emulsion layer and a red sensitive silver halide emulsion layer, the relative proportions of materials being such that oxidized developing agent generated in the areas of the green sensitive layer receiving maximum exposure migrates to the interlayer to couple to form cyan dye. This results in extension of exposure latitude of the green sensitive layer by the addition of cyan dye density in the maximum density region of the magenta dye image. In a high density red image, comprised of yellow and magenta dye, this would be seen in the viewable image as an increase in detail of the red image. Similarly, detail of the high-density green image is increased, and exposure latitude of the red sensitive emulsion extended, when the interlayer contains a magenta dye-forming coupler and forms magenta dye density as a function of red light exposure.

Dye-forming couplers have been placed in non-light-sensitive layers adjacent image-forming layers. In some instances, these have been development inhibitor-releasing couplers which were not present for the image-forming character of the coupler itself, but rather as a carrier for a development inhibitor to be released. U.S. Pat. No. 4,359,521 is illustrative of such patents. In other instances, the coupler forms a dye complementary to the sensitivity of the emulsion layer from which the oxidized developing agent migrates. German DAS 1,002,626 and U.S. Pat. No. 4,186,011 are illustrative of such patents. In column 4, lines 37–42, of the '011 patent it is stated that coupling between oxidized developing agent migrating from an emulsion layer of one color with a coupler forming dye of a different color is undesirable and should be suppressed. The present invention, on the other hand, makes use of such coupling to achieve an extension of exposure latitude.

As indicated above, the relative proportions and locations of the emulsions and couplers in the two light-sensitive layers and the interlayer should be such that oxidized developing agent is generated in the maximum density areas of the first emulsion layer in such an amount that there is excess oxidized developing agent available to migrate to the interlayer where it will couple. Such a condition can be assured by having less coupler in the first emulsion layer than is theoretically capable of reacting with all of the oxidized developing agent generated at maximum exposure. This condition has been referred to in the art as "coupler starvation." However, some oxidized developing agent would be available for migration even under non-coupler starved conditions. Therefore, it is not necessary that the emulsion be coupler starved in order for the benefits of the invention to be observed.

The amount of oxidized developing agent which migrates to the interlayer can be determined by measuring and plotting the density of dye generated in the interlayer as a function of exposure of the first emulsion layer. The slope of the resulting curve is referred to as contrast, or gamma($\gamma$). Useful effects can be obtained when the contrast of the interlayer, measured in the region where the first emulsion layer is within 10% of maximum density, is in the range of 0.03 to 7.0, preferably in the range of 0.07 to 3.5. Especially preferred is an interlayer contrast of 0.2 to 0.4.

The contrast of the interlayer can also be related to the secondary contrast of the first emulsion layer measured in the same region of the spectrum as is the interlayer. This is referred to herein as the corresponding contrast. Useful effects can be obtained when the contrast of the interlayer is in the range of 10% to 200% of the corresponding contrast of the first emulsion layer. Preferably the corresponding contrast is 40% to 200%. The corresponding contrast of each layer is measured as a function of exposure of the first emulsion layer. The corresponding contrast of the first emulsion layer is that of the straight line portion of the curve. The contrast of the interlayer is measured over the exposure region where the principal density of the first emulsion layer is within 10% of maximum density.

This can be illustrated by reference to FIG. 1 of the invention, which shows the response obtained with a material like that illustrated in Example 1, compared with the control. In this example, the first emulsion layer is sensitive to the green region of the spectrum and contains a magenta dye-forming coupler, and, in the material of the invention, the interlayer contains a cyan dye-forming coupler. The curve labeled Gg represents the green density, i.e. the principal density, generate in the element as a function of exposure of the green sensitive layer. The curve labelled Rg represents the red density generated in the element as a function of exposure of the green sensitive layer. It is composed of two parts. The first, labelled 1, is derived from absorption of red light by the magenta dye formed in the green layer. This is the secondary density of the dye formed in the green sensitive layer. The second, dashed curve, labelled 2, represent the cyan dye formed in the interlayer as a function of development of the green sensitive layer. The additional red density, represented by the dashed curve labelled 2, adds to the green density in the maximum density region of the image thus extending exposure latitude and enhancing image detail.

An additional or alternative means for controlling migration of oxidized color developing agent is by the use of a barrier layer. There can be located between the interlayer and the second emulsion layer a barrier layer containing a scavenger for oxidized developing agent. Suitable scavengers include ballasted reducing agents such as 2-(-2-octadecyl)-5-sulfohydroquinone, diiso octylhydroquinone, 2-5,-didodecylhydroquinone, 4-benzenesulfonamido-1-hydroxy-2-(N,N didodecyl) naphthamide. The presence of such a material in this location will restrict the opportunity for the coupler in the interlayer to respond to the second emulsion layer rather than to the first emulsion layer.

The present invention is of primary use in materials intended for direct viewing, such as reflection prints. The contribution to maximum density from two different regions of the spectrum results in some desaturation of the color in the maximum density portions of the image. This is not a significant factor in reflection print materials. The invention also can be employed with color negative, and other intermediate materials, where desaturation of the color in maximum density regions is acceptable.

Color photographic elements intended for direct viewing by reflection generally comprise an opaque support on which is coated, in order, a blue-sensitive, yellow dye forming layer, a green-sensitive magenta dye-forming layer, and a red-sensitive cyan dye-forming layer. In a preferred embodiment of the present invention, the non-light interlayer containing the dye-forming coupler is coated between the red-sensitive and green-sensitive emulsion layers.

Any conventional silver halide emulsion can be employed. For color print applications, silver chloride, silver bromide and silver chlorobromide emulsions are commonly employed. The silver halide emulsions employed in positive print materials are in most applications negative working. Illustrative silver halide emulsion types in preparations are disclosed in *Research Disclosure,* Volume 176, January, 1978, Item 17643, paragraph I. Particularly preferred silver halide emulsions are high aspect ratio tabular grain emulsions such as those described in *Research Disclosure,* January, 1983, Item 22534. *Research Disclosure* is published by Kenneth Mason Publications, Ltd., The Old Harbourmaster's, 8 North Street, Emsworth, Hampshire P010 7DD, ENGLAND.

Dye-forming couplers are chosen to form subtractive primary (i.e. yellow, magenta and cyan) image dyes and are non-diffusible colorless compounds such as 2- and 4-equivalent couplers of the open-chain ketomethylene, pyrazolone, pyrazolotriazole, phenol and naphthol types that are hydrophobically ballast for incorporation in high-boiling organic solvents. Suitable types and classes of couplers, as well as methods for their incorporation in color photographic materials, are described in *Research Diclosure,* Item 17643, December, 1978, Section VII, Paragraphs C, D, E, F and G, Incorporated herein by reference.

Specifically preferred couplers for use in the reflection print materials of this invention include the following:

Suitable yellow dye-forming couplers are:

-continued
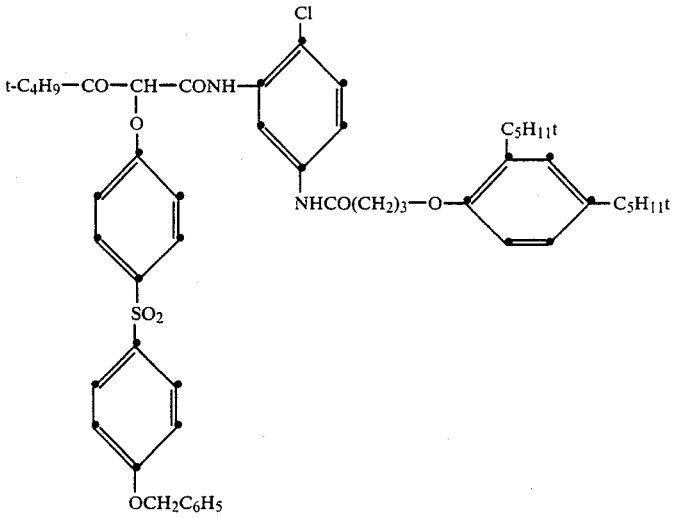
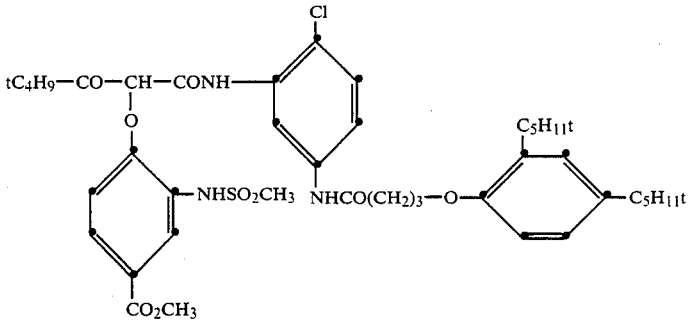
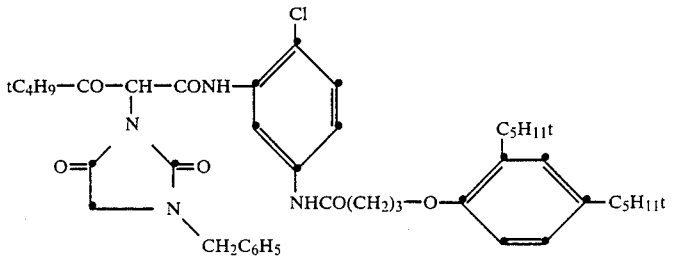
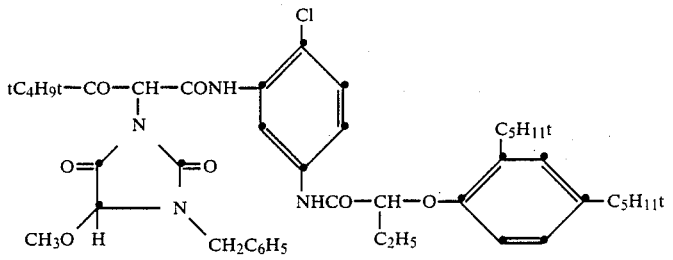
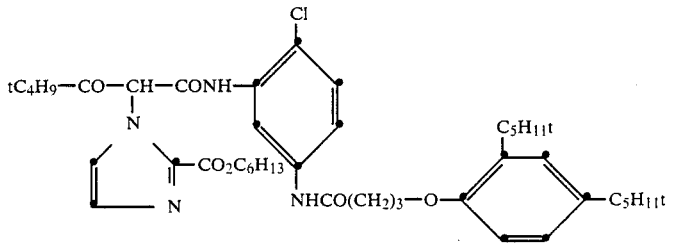
Suitable magenta dye-forming couplers are:

-continued
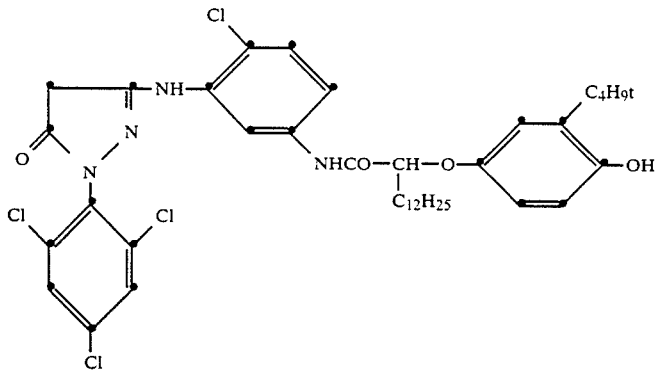
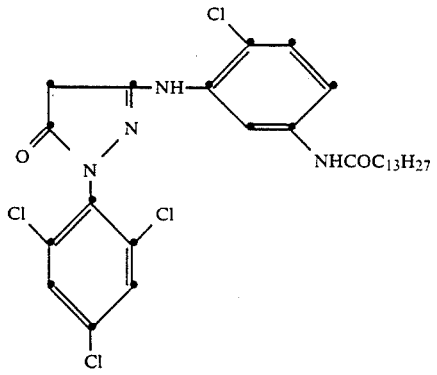
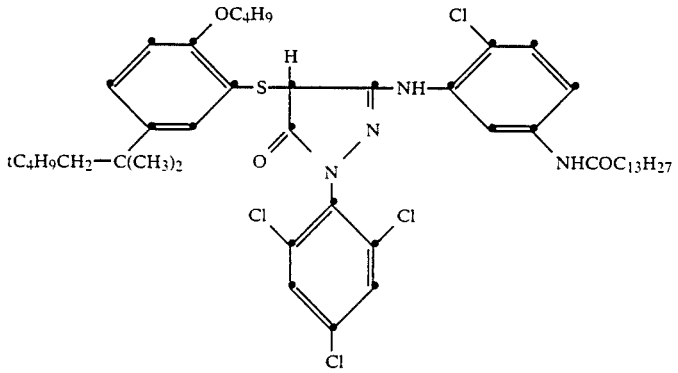
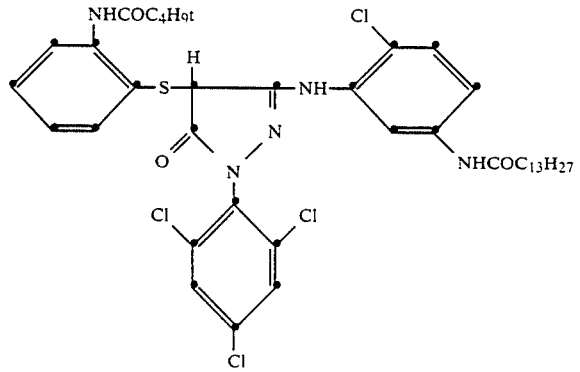

-continued
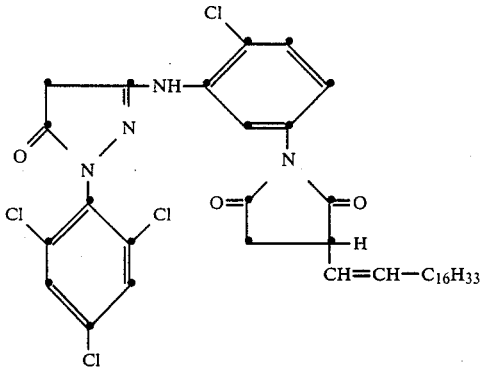
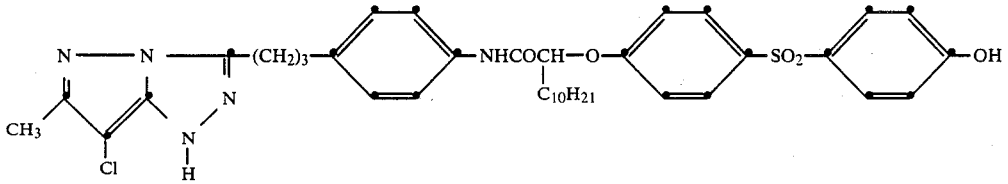
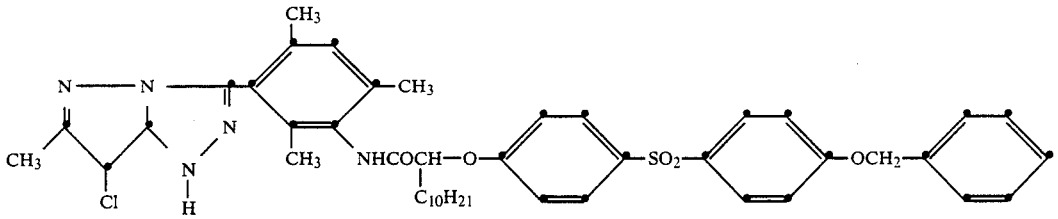
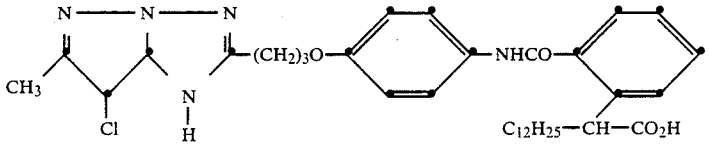
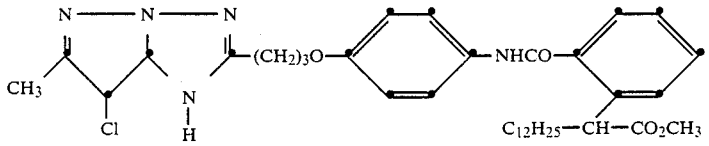
Suitable cyan dye-forming couplers are:
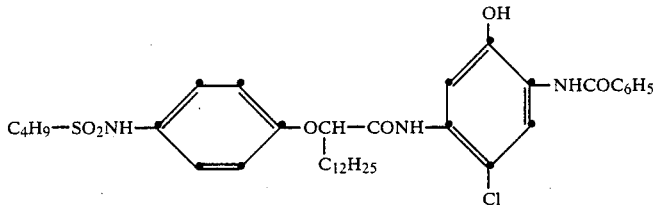
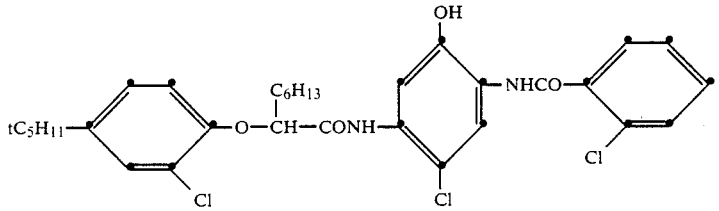

-continued

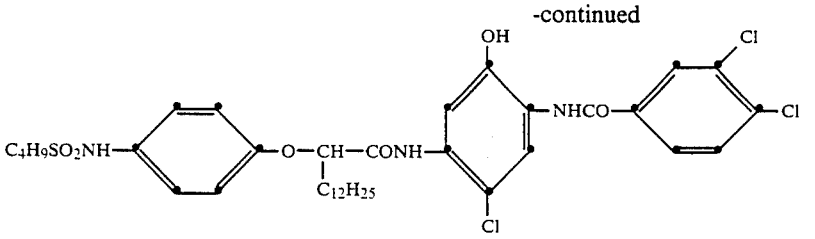

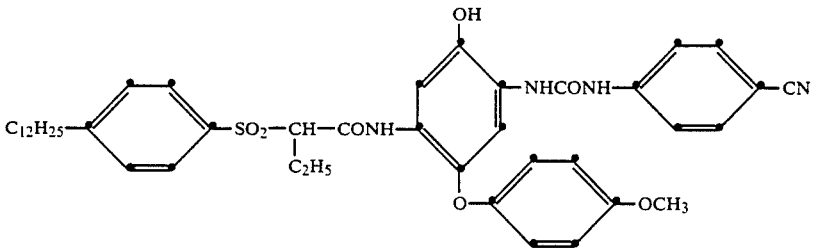

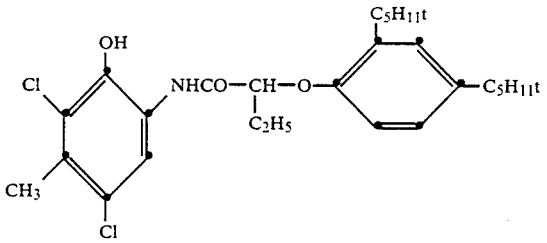

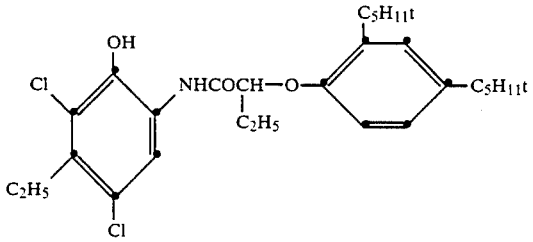

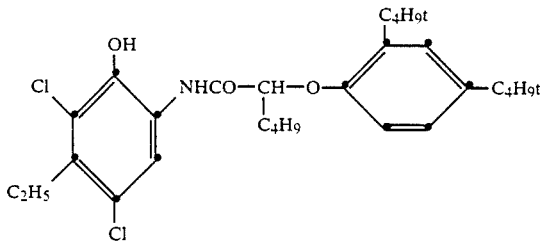

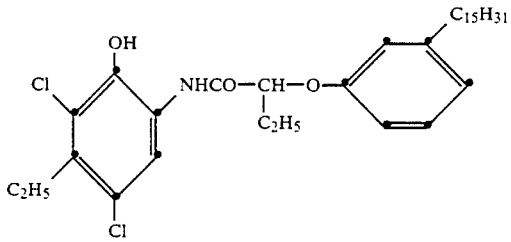

The photographic element can be comprised of any conventional photographic support. Typical photographic supports include wood fiber, e.g. paper, metallic sheets and foils, glass and ceramic supporting elements provide with one or more subbing layers to enhance the adhesive, antistatic, dimensional, abrasive hardness, frictional antihalation or other properties of the support services. Typically, useful supports are further disclosed in *Research Disclosure,* Item 17643, paragraph XVII.

In addition to the features described above, the photographic elements can contain other conventional features known in the art, which can be illustrated by reference to *Research Disclosure,* Item 17643, cited above. For example, the silver halide emulsions can be chemically sensitized, as described in Paragraph III; contain brighteners, as described in Paragraph V; contain antifoggants and stabilizers, as described in Paragraph VI; absorbing and scattering materials, as described in Paragraph III, the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasticizers and lubricants, as described in Paragraph XII; and the layers, particularly the layers farthest from the support, can contain matting agents, as described in Paragraph XVI. This exemplary listing of addenda and features is not intended to restrict or imply the absence of other conventional photographic features compatible with the practice of the invention.

Following imagewise exposure, multilayer color photographic elements of this invention can be processed by any conventional technique of producing a dye image by color development, whereafter the concurrently generated silver is removed by bleaching. Residual, undeveloped silver halide can be removed in a separate fixing step or concurrently with bleaching. A separate pH lowering solution, referred to as a stop bath, may be employed to terminate development prior to bleaching. A stabilizer bath is commonly employed for final washing and hardening of the bleached and fixed photographic element prior to drying. Conventional techniques for processing are illustrated by *Research Disclosure,* Item 17643, cited above, Paragraph XIX.

The following example further illustrates the invention.

EXAMPLE 1

A control color photographic material was prepared by coating the following layers in sequence on a polyethylene laminated paper support. The coating was hardened with bis(vinylsulfonyl) methyl ether at 1.8% of the total gelatin weight. Except as noted, all coverages in parenthesis are in g/m$^2$.

| | |
|---|---|
| Layer 7 | Gelatin (1.35) |
| Layer 6 | Gelatin (0.69) - UV absorber |
| Layer 5 | Chemically sensitized and red spectrally sensitized monodisperse silver chloride emulsion, average grain diameter 0.48 μm, silver coverage (0.23), gelatin coverage (1.08), and the cyan dye-forming coupler C* (0.43) |
| Layer 4 | Gelatin (0.69) - UV absorber |
| Layer 3 | Chemically sensitized and green spectrally sensitized monodisperse silver chloride emulsion, average grain diameter 0.38 μm, silver coverage (0.33), gelatin coverage (1.23), and the magenta dye-forming coupler M* (0.47) |
| Layer 2 | Gelatin (1.50) |
| Layer 1 | Chemically sensitized and blue spectrally sensitized monodisperse silver chloride emulsion, average grain diameter 0.8 μm, silver coverage (0.42), gelatin coverage (1.50), and the yellow dye-forming coupler Y* (1.08) |
| Support | Polyethylene coated paper |

C=Cyan dye-forming coupler 2-[α-(2,4-ditert-amylphenoxy)butyramido]-4,6-dichloro-5-ethyl phenol M=Magenta dye-forming coupler 1-(2,4,6-trichlorophenyl)-3-[2-chloro-5-(α-[4-hydroxy-3-tert-butylphenoxy]tetradecanoamido)anilino]-5-pyrazolone Y=Yellow dye-forming coupler α[4-(4-benzyloxyphenylsulfonyl)phenoxy]-α-pivalyl-2-chloro-5-[γ(2,4-t-amylphenoxy)-butyramido]-acetanilide A color photographic material according to this invention was prepared. It differed from the one described above in that layer 4 contained 100 mg/m$^2$ of cyan dye-forming coupler C and an additional 0.69 g/m$^2$ of gelatin.

Each of these photographic materials was imagewise exposed through a green separation test object (Wratten 99 filter) and then processed at 35° C. in a three step process consisting of a 45-second development step, a 45-second bleach fix step, and a 90-second stabilizing step, followed by a one minute drying step at a temperature of 60° C.

The color developing, bleach-fixing and stabilizing compositions used in the process were as follows:

| Color Developing Composition | |
|---|---|
| Lithium salt of sulfonated polystyrene (30% by wt) | 0.25 mL |
| Triethanolamine | 11.0 mL |
| N,N-diethylhydroxylamine (85% by wt) | 6.0 mL |
| Potassium sulfite (45% by wt) | 0.5 mL |
| Color developing agent* | 5.0 g |
| Stain reducing agent** | 2.3 g |
| Lithium sulfate | 2.7 g |
| Potassium chloride | 2.3 g |
| Potassium bromide | 0.025 g |
| Kodak Anti-Calcium No. 5*** | 0.8 mL |
| Potassium carbonate | 25.0 g |
| Water to total of 1 liter | (pH 10.04) |

*4-(N-ethyl-N-2-methanesulfonamidoethyl)-2-methylphenylenediaminesesquisulfate monohydrate.
**A stilbene compound available under the trademark KODAK EKTAPRINT 2 Stain-Reducing Agent from Eastman Kodak Company.
***An organic phosphonic acid

| Bleach-Fixing Composition | |
|---|---|
| Ammonium thiosulfate | 58. g |
| Sodium sulfite | 8.7 g |
| Ethylenediaminetetraacetic acid ferric ammonium salt | 40. g |
| Acetic acid | 9.0 mL |
| Water to total 1 liter, pH adjusted to 6.2 | |
| **Stabilizing Composition** | |
| Sodium citrate | 1 g |
| Dearside (a biocide produced by Rohm and Haas) | 45 ppm |
| Water to total 1 liter, pH adjusted to 7.2 | |

The control material developed 11 visible steps while the invention material developed 15 visible steps. A similar increase in exposure latitude is obtained when the level of magenta dye forming coupler M in layer 3 is reduced to 0.38 g/m$^2$ and the level of cyan dye forming coupler C in layer 4 is 0.32 mg/m$^2$.

This data leads to the conclusion that the invention materials have extended exposure latitude compared with the control material and can record more detail in high density regions of the image.

EXAMPLE 2

The control and invention color photographic print materials described in Example 1 were imagewise exposed to a color negative image and processed as in Example 1. Visual inspection of the resulting prints showed significantly greater detail in the red-image areas on the print materials of the invention compared to the control.

The invention has been described in detail with particular reference to preferred embodiments thereof, but it will be understood that variations and modifications can be effected within the spirit and scope of the invention.

What is claimed is:

1. A color photographic reflection print material comprising an opaque support, first and second silver halide emulsion layers each sensitive to a different region of the electromagnetic spectrum and each containing a coupler that forms a dye complementary in color to the principal spectral sensitivity of the emulsion and a non-light sensitive interlayer between the two emulsion layers, wherein:

the interlayer contains a non-diffusible colorless coupler that forms, as a function of development of the first emulsion layer, a dye complementary in color to the principal sensitivity of the second emulsion layer.

2. A photographic element of claim 1 wherein:

the first emulsion layer is sensitive to the green region of the spectrum and contains a magenta dye-forming coupler;

the second emulsion layer is sensitive to the red region of the spectrum and contains a cyan dye-forming coupler; and the interlayer contains a cyan dye-forming coupler.

3. A photographic element of claim 1 wherein:

the first emulsion layer is sensitive to the red region of the spectrum and contains a cyan dye-forming coupler;

the second emulsion layer is sensitive to the green region of the spectrum and contains a magenta dye-forming coupler; and the interlayer contains a magenta dye-forming coupler.

4. A photographic element of claim 2 wherein the cyan dye-forming coupler in each of the second emulsion layer and the interlayer is 2-[-α-(2,4-di-tertamylphenoxy)-butyramido]-4,6-dichloro-5-ethyl phenol and the magenta dye-forming coupler is 1-(2,4,6-trichlorophenyl)-3-[2-chloro-5-(α(4-hydroxy-3-tertbutylphenoxy)tetradecanoamido)-anilino]-5-pyrazolone.

5. A photographic element of claim 3 wherein the cyan dye-forming coupler is 2-[-α-(2,4-di-tertamylphenoxy)-butyramido]-4,6-dichloro-5-ethyl phenol and the magenta dye-forming coupler in each of the second emulsion layer and the interlayer is 1-(2,4,6-trichlorophenyl)-3-[2-chloro-5-(α(4-hydroxy-3-tert-butylphenoxy)tetra-decanoamido)-anilino]-5-pyrazolone.

6. A color photographic reflection print material comprising an opaque support, first and second silver halide emulsion layers each sensitive to a different region of the electromagnetic spectrum and each containing a coupler that forms a dye complementary in color to the principal spectral sensitivity of the emulsion and a non-light sensitive interlayer between the two emulsion layers, wherein:

the interlayer contains a non-diffusible colorless coupler that forms, as a function of development of the first emulsion layer, a dye complementary in color to the principal sensitivity of the second emulsion layer, wherein the relative proportions of couplers is such that, upon exposure and processing, the contrast of the dye formed in the interlayer is 0.07 to 3.5, in the region where the dye formed in the first emulsion layer is within 10% of maximum density.

7. A photographic element of claim 6 wherein the contrast is 0.2 to 0.4.

8. A color photographic reflection print material comprising an opaque support, first and second silver halide emulsion layers each sensitive to a different region of the electromagnetic spectrum and each containing a coupler that forms a dye complementary in color to the principal spectral sensitivity of the emulsion and a non-light sensitive interlayer between the two emulsion layers, wherein:

the interlayer contains a non-diffusible colorless coupler that forms, as a function of development of the first emulsion layer, a dye complementary in color to the principal sensitivity of the second emulsion layer, wherein the relative proportions of couplers is such that, upon exposure and processing, the contrast of the dye formed in the interlayer is 10% to 200% of the corresponding contrast of the dye formed in the first emulsion layer.

9. A photographic element of claim 8 wherein the contrast of the interlayer is 40% to 100% of the corresponding contrast of the first emulsion layer.

10. A photographic element of any one of claims 1, 6 or 8 wherein a scavenger for oxidized developing agent is between the interlayer and the second emulsion layer,

11. A color photographic reflection print material comprising, in order:

an opaque support;

a blue sensitive silver halide emulsion layer containing a yellow dye forming coupler;

a green sensitive silver halide emulsion layer containing a magenta dye-forming coupler;

an interlayer; and a red sensitive silver halide emulsion layer, containing a cyan dye-forming coupler; wherein:

the interlayer contains a cyan dye-forming coupler; and the proportions of coupler and silver halide in each of the green sensitive layer, red-sensitive layer and interlayer are such that cyan dye is formed in the interlayer in response to exposure of the green-sensitive layer in an amount such that the contrast in the interlayer is from 10% to 200% of the corresponding contrast in the green-sensitive layer.

* * * * *